US006792649B2

(12) United States Patent
Paterson et al.

(10) Patent No.: US 6,792,649 B2
(45) Date of Patent: Sep. 21, 2004

(54) CONTOURED INTAKE DUCTS AND FAN HOUSING ASSEMBLIES FOR FLOOR CARE MACHINES

(75) Inventors: Chris M. Paterson, Long Beach, MS (US); Jeffrey A. Millard, Long Beach, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 37 days.

(21) Appl. No.: 10/141,472

(22) Filed: May 8, 2002

(65) Prior Publication Data

US 2002/0138941 A1 Oct. 3, 2002

Related U.S. Application Data

(62) Division of application No. 09/675,284, filed on Sep. 29, 2000, now abandoned.

(51) Int. Cl.[7] ..... A47L 9/22; A47L 5/22

(52) U.S. Cl. ..... 15/412; 15/326; 415/205; 415/206; 415/208.1; 415/215.1

(58) Field of Search ..... 15/326, 412; 415/205.1, 415/204, 205, 206, 214.1, 215.1

(56) References Cited

U.S. PATENT DOCUMENTS

| | | | | |
|---|---|---|---|---|
| 2,677,850 A | | 5/1954 | Brace | |
| 3,210,792 A | | 10/1965 | Sassano, Sr. | |
| 3,592,566 A | | 7/1971 | Beardslee | |
| 3,763,635 A | | 10/1973 | Schmitz | |
| 3,771,192 A | | 11/1973 | Zaleski | |
| 4,120,616 A | | 10/1978 | Dwyer et al. | |
| 4,514,200 A | | 4/1985 | Sumerau et al. | |
| 4,701,975 A | | 10/1987 | Hampton et al. | |
| 4,799,287 A | * | 1/1989 | Belanger et al. | 415/206 |
| 4,811,450 A | | 3/1989 | Steadings | |

(List continued on next page.)

*Primary Examiner*—Theresa T. Snider
(74) *Attorney, Agent, or Firm*—Duft Setter Ollila & Bornsen LLC

(57) ABSTRACT

Contoured intakes and fan housing assemblies for floor care machines are disclosed. In one embodiment, a contoured intake includes a contoured duct having a passage therethrough. The passage has a cross-sectional area progression that smoothly varies between a first cross-sectional area and a second cross-sectional area. Turbulence within the intake passage may be reduced or inhibited, and noise generated by the airstream within the intake passage may be reduced. In another embodiment, the contoured duct may include a bellmouth substantially surrounding the first open end that may inhibit the separation of the airstream within the intake passage. In a further embodiment, an airflow propulsion device for a floor care machine may include a motor having a drive shaft, a fan operatively coupled to the drive shaft, and a fan housing disposed about the fan and having a transition passage proximate the radially-outward ends of the vanes of the fan. The fan housing includes an internal cowling surface closely conforming to and closely spaced from the distal edges of the vanes of the fan. In another embodiment, the transition passage has a cross-sectional area progression that smoothly varies between a first cross-sectional area proximate one of the vanes and a second cross-sectional area proximate an exhaust opening. Turbulence within the fan housing may be reduced or inhibited, and noise generated by the airstream within the fan housing may be reduced.

9 Claims, 10 Drawing Sheets

U.S. PATENT DOCUMENTS 4,905,341 A 3/1990 Sunagawa et al.
4,996,737 A 3/1991 Madru, Sr.
5,115,538 A 5/1992 Cochran et al.
5,216,779 A 6/1993 Glenn, III
5,222,276 A 6/1993 Glenn, III
5,228,169 A 7/1993 Stein et al.
5,230,121 A 7/1993 Blackman
5,281,092 A * 1/1994 Sullivan ..... 415/206
5,311,638 A 5/1994 Fureron et al.
5,323,510 A 6/1994 Redding et al.
5,345,650 A 9/1994 Downham et al.
5,367,741 A 11/1994 Hampton et al.
5,383,252 A 1/1995 Hampton et al.
5,388,302 A 2/1995 Sundaram et al.
5,414,893 A 5/1995 Hampton et al.
5,448,794 A * 9/1995 Walch et al. ..... 15/326
5,513,418 A 5/1996 Weber
5,584,095 A 12/1996 Redding et al.
5,606,770 A 3/1997 Sovis et al.
5,774,930 A 7/1998 Sommer et al.
5,839,879 A * 11/1998 Kameoka et al. ..... 415/206
5,852,847 A 12/1998 Weiss et al.
5,911,261 A 6/1999 Farone et al.
5,919,030 A 7/1999 Iwatake et al.
6,009,594 A 1/2000 Grey
6,039,817 A 3/2000 Payne
6,055,701 A 5/2000 Grey et al.
6,055,703 A 5/2000 Redding et al.
6,148,473 A 11/2000 Embree et al.
6,243,916 B1 6/2001 Embree et al.
6,246,133 B1 6/2001 Embree et al.

* cited by examiner

CONTOURED INTAKE DUCTS AND FAN HOUSING ASSEMBLIES FOR FLOOR CARE MACHINES

CROSS REFERENCE TO A RELATED APPLICATION

This application is a divisional of U.S. patent application Ser. No. 09/675,284 titled "CONTOURED INTAKE DUCTS AND FAN HOUSING ASSEMBLIES FOR FLOOR CARE MACHINES" and filed 29 Sep. 2000, now abandoned. The referenced application is hereby incorporated by reference as if the referenced application were included in this application.

TECHNICAL FIELD

The present invention relates to contoured intake ducts and fan housing assemblies for floor care machines, such as vacuums, extractors, steam cleaners, and the like.

BACKGROUND OF THE INVENTION

Many contemporary floor care machines are equipped with vacuum motors or other suction-generating apparatus for drawing particulates, fluids, or other materials from a floor surface and propelling such materials into a storage receptacle. Such floor care machines include upright and canister vacuums, extractors, steam cleaners, carpet shampooers, and other similar devices.

FIG. 1 is a side elevational, partially-exploded view of a floor care machine 20 (e.g. an upright vacuum) in accordance with the prior art. As is well known, the floor care machine 20 includes a head assembly 40 that engages a floor surface 22, and a dirt receptacle 26 for receiving and storing particulates. An exhaust duct 28 extends upwardly from the head assembly 40 and has an exhaust outlet 29 that extends partially into the dirt receptacle 26. A handle support 30 extends upwardly from the exhaust duct 28, and a handle 32 is attached to an upper end of the handle support 30.

FIG. 2 is an exploded isometric view of the head assembly 40 of the floor care machine 20 of FIG. 1. The head assembly 40 includes a motor assembly 42 having a fan housing 50 and a drive shaft 44 coupled to a drive belt 46. A roller brush 48 is also coupled to the drive belt 46. The fan housing 50 includes an intake opening 52 and an exhaust opening 54. The head assembly 40 also includes a lower housing 56, and an upper housing 58 that engages with the lower housing 56 to cover and protect the internal components of the head assembly 40.

The upper and lower housing 58, 56 form a suction compartment 60 surrounding the roller brush 48, and an intake duct 62 extending between the suction compartment 60 and the intake opening 52 of the fan housing 50. The intake duct 62 has a generally rectangular cross-section from the suction compartment 60 to the fan housing 50, however, at the point where the intake duct 62 meets the intake opening 52 of the fan housing 50, the cross-sectional shape of the intake duct 62 abruptly changes from a relatively large rectangular cross-sectional shape to a relatively small circular exit aperture 63. At the bottom of the suction compartment 60, an intake aperture 64 is disposed through the lower housing 56 that leads into the suction compartment 60.

In use, an operator grips the handle 32 and actuates a control switch (not shown) to transmit power to the motor assembly 42. As will be understood by persons of ordinary skill in the art, the motor assembly 42 creates suction within the suction compartment 60, drawing a particulate-laden airstream from the floor surface 12 through the intake aperture 64. The motor assembly 42 propels the particulate-laden airstream through the intake duct 62 and into the fan housing 50.

The particulate-laden airstream is then driven through the fan housing 50 and the exhaust duct 28, and into the dirt receptacle 26, where the particulates may be filtered from the particulate-laden airstream and stored for later disposal. Floor care machines of the type shown in FIGS. 1 and 2 are disclosed, for example, in U.S. Pat. No. 5,584,095 issued to Redding et al, U.S. Pat. No. 5,367,741 issued to Hampton et al, U.S. Pat. No. 5,230,121 issued to Blackman, U.S. Pat. No. 5,222,276 issued to Glenn, and U.S. Pat. No. 5,774,930 issued to Sommer et al.

Although desirable results have been achieved using the floor care machine 20, some drawbacks exist. For example, although the noise generated by floor care machines is of low volume and well within established limits for the comfort and safety of the operator and other persons in the vicinity of the machine, it may be desirable to further reduce the noise generated from the floor care machine. For some applications, such as in hospitals, hotels, or residential applications, it may be desirable to operate floor care machines while people are sleeping nearby. For other applications, such as in schools, universities, or office buildings, it may be desirable to operate floor care machines while people are quietly concentrating or conversing. Therefore, there is an ever-present desire to further reduce the noise generated by floor care machines.

SUMMARY OF THE INVENTION

The present invention is directed to contoured intake ducts and fan housing assemblies for floor care machines. In one aspect, an intake apparatus for a floor care machine includes a contoured duct having a passage therethrough, the passage having a first cross-sectional area at a first open end of the passage and a second cross-sectional area at a second open end of the passage. The first open end of the passage is adapted to be fluidly connected to a suction compartment of the floor care machine, and the second open end of the passage is adapted to be fluidly connected to an opening of an airflow propulsion device. The passage has a cross-sectional area progression from the first open end to the second open end that smoothly varies between the first cross-sectional area and the second cross-sectional area. Because the intake passage has a smoothly varying area progression, turbulence within the intake passage may be reduced or inhibited, and noise generated by the airstream within the intake passage may be reduced.

In another aspect, the contoured duct may include a bellmouth substantially surrounding the first open end. The bellmouth may inhibit the separation of the airstream within the intake passage, and thus, noise generated by the airstream within the intake passage may be reduced.

In a further aspect, an airflow propulsion device for a floor care machine may include a motor having a drive shaft, a fan operatively coupled to the drive shaft, and a fan housing disposed about the fan and having a transition passage proximate the radially-outward ends of the vanes of the fan. The transition passage extends to an exhaust opening and being sized to receive the outwardly-driven airflow from the fan. In one aspect, the fan housing includes an internal cowling surface closely conforming to and closely spaced from the distal edges of the vanes of the fan. In another aspect, the transition passage also has a cross-sectional area progression that smoothly varies between a first cross-sectional area proximate one of the vanes and a second cross-sectional area proximate the exhaust opening. Turbulence within the fan housing may be reduced or inhibited, and noise generated by the airstream within the fan housing may be reduced.

DETAILED DESCRIPTION OF THE INVENTION

The present invention is generally directed to contoured intake ducts and fan housing assemblies for floor care machines. Many specific details of certain embodiments of the invention are set forth in the following description and in FIGS. 3–12 to provide a thorough understanding of such embodiments. One skilled in the art will understand, however, that the present invention may have additional embodiments, or that the present invention may be practiced without several of the details described in the following description.

Figure 3:
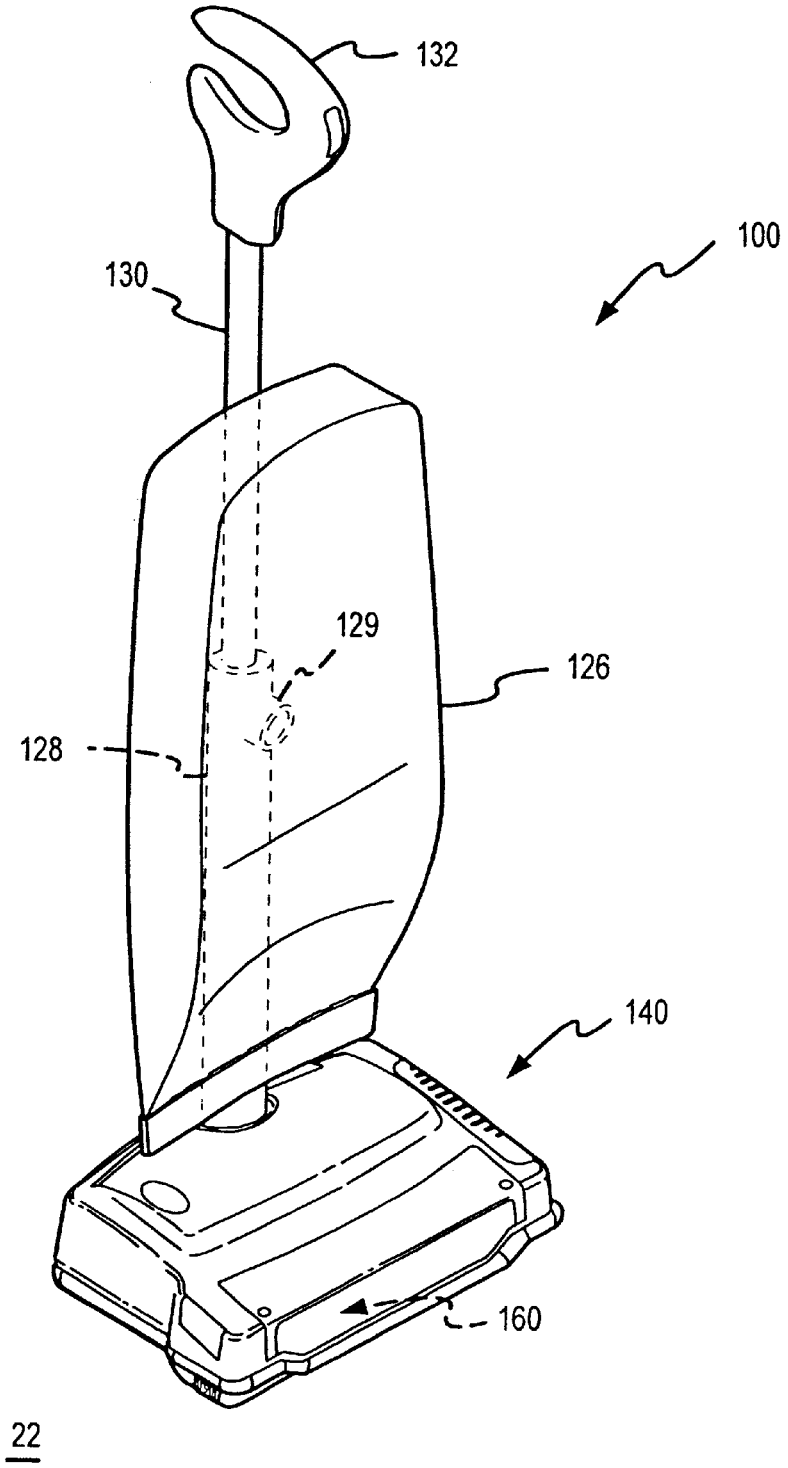
FIG. 3 is an isometric view of a floor care machine in accordance with an embodiment of the invention.

FIG. 3 is an isometric view of a floor care machine 100 in accordance with an embodiment of the invention. In this embodiment, the floor care machine 100 is an upright vacuum cleaner having a vacuum head 140 engageable with a floor surface 22, and a dirt receptacle 126. An exhaust duct 128 extends upwardly from the vacuum, head 140 and includes an exhaust outlet 129 that extends partially into the dirt receptacle 126. A handle support 130 extends upwardly from the exhaust duct 128 to a handle 132.

Figure 4:
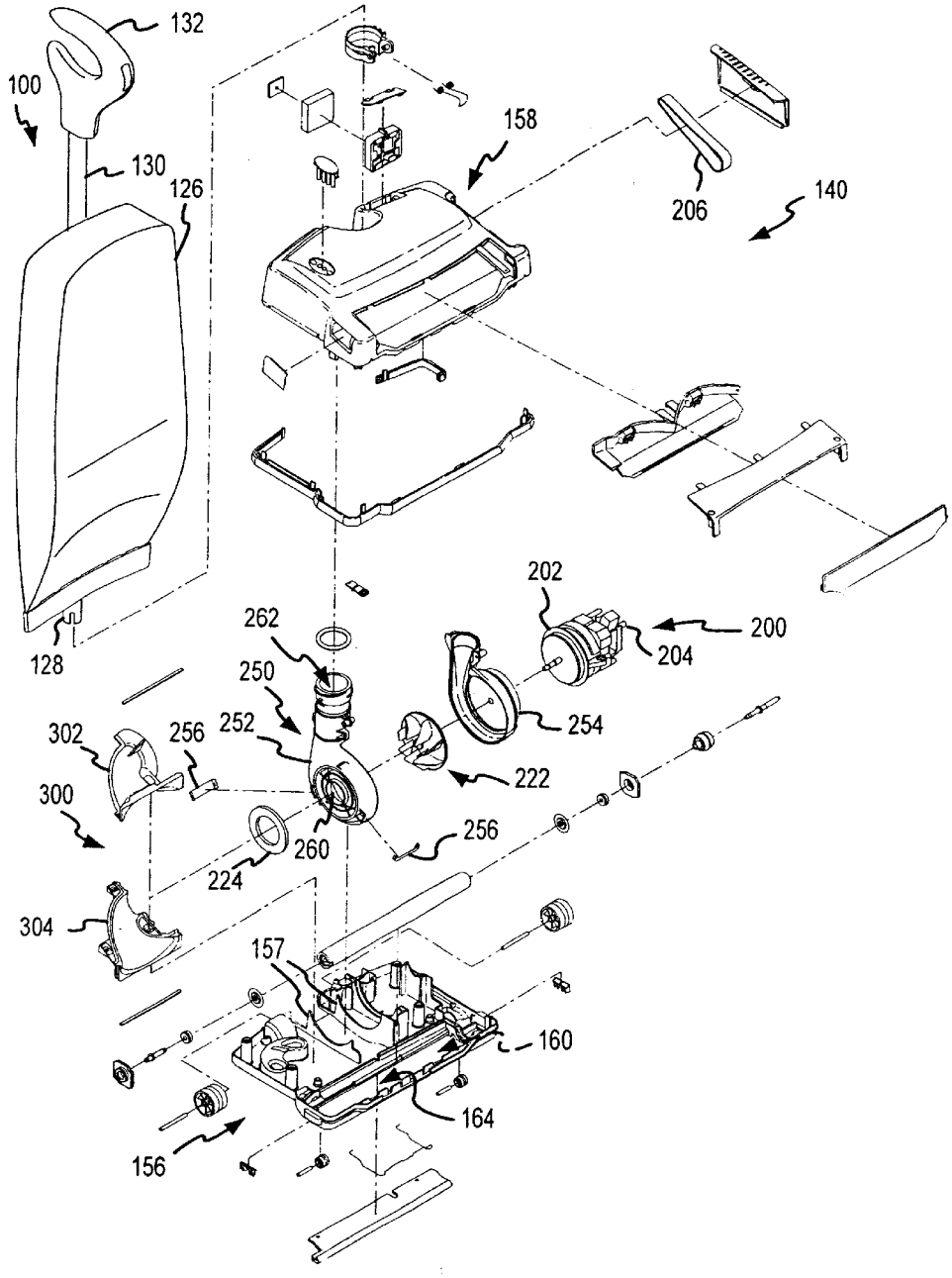
FIG. 4 is an isometric, partially-exploded view of a vacuum head assembly of the floor care machine of FIG. 3.

FIG. 4 is an isometric, partially-exploded view of the vacuum head 140 of FIG. 3. The vacuum .head 140 includes a lower housing 156 and an upper housing 158. An airflow propulsion device 200 is disposed within the vacuum head. 140 between the upper and lower housings 158, 156. A suction compartment 160 is formed between the upper and lower housings 158, 156. An intake aperture 164 is disposed through the lower housing 156 and leads into the suction compartment 160.

The airflow propulsion device 200 includes a motor 202 having a drive shaft 204, and a fan housing 250 that encloses a fan 222 connected to the drive shaft 204. A drive belt 206 is coupled to the drive shaft 204, and a roller brush is positioned within the suction compartment 160 and is coupled to the drive belt 206. As the motor 202 turns, the drive shaft 204 drives the fan 222 and the roller brush via the drive belt 206. The vacuum head 140 also includes a contoured intake duct 300. A seal 224 is disposed between the intake duct 300 and the fan housing 250.

Figure 1:
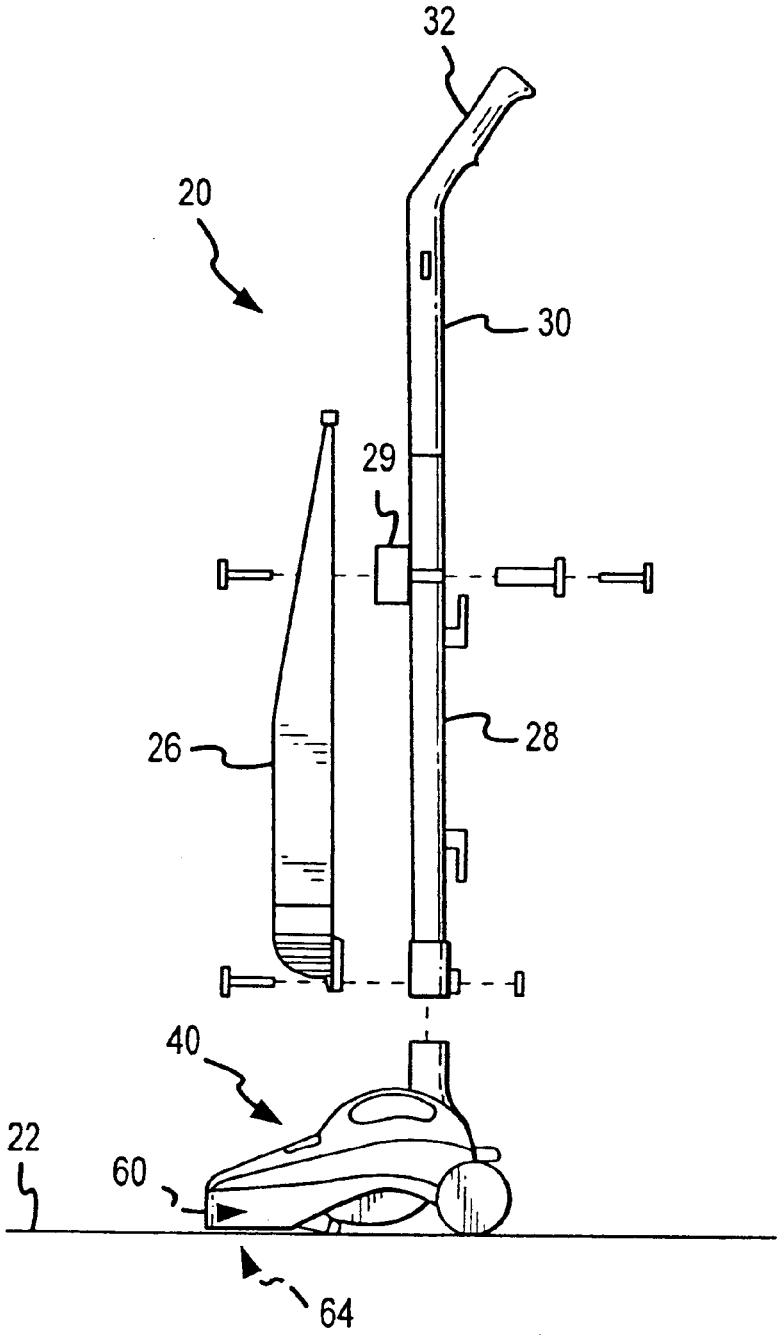
(PRIOR ART) FIG.1
FIG. 1 is a side elevational, partially-exploded view of a floor care machine in accordance with the prior art.
Figure 2:
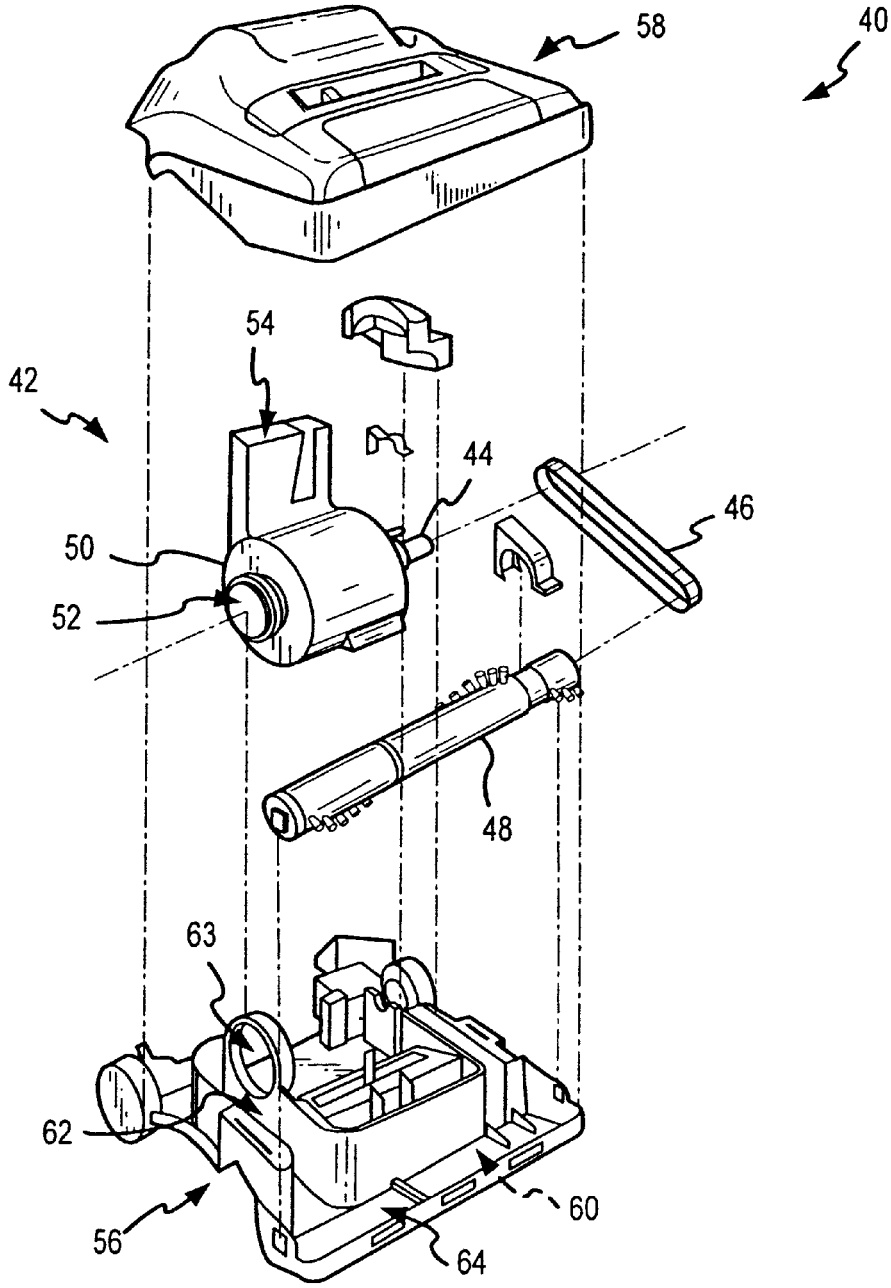
(PRIOR ART) FIG.2
FIG. 2 is an exploded isometric view of a head assembly of the floor care machine of FIG. 1.
Figure 5:
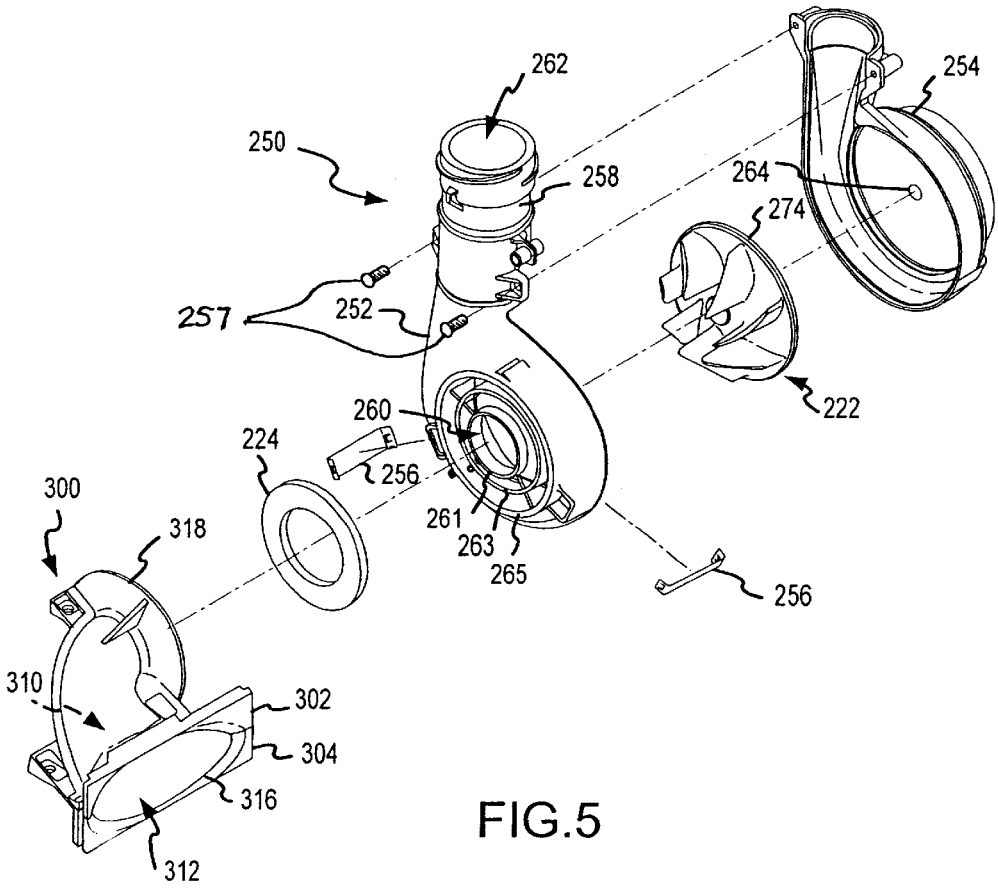
FIG. 5 is an exploded isometric view of a fan housing and an intake duct of FIG. 4.

FIG. 5 is an exploded isometric view of the fan housing 250 and the intake duct 300 of FIG. 4. The fan housing 250 includes left and right portions 252, 254 held together by a pair of spring clips 256 and a pair of screws 257 (shown in FIG. 4). The left portion 252 has a central opening 260 through which air may flow into the fan housing 250, and a coupling section 258 having an exhaust outlet 262 that connects to the exhaust conduit 128 (FIGS. 2 and 3). The right portion 254 includes a shaft opening 264 through which the drive shaft 204 (not shown) extends to connect to the fan 222.

Figure 6:
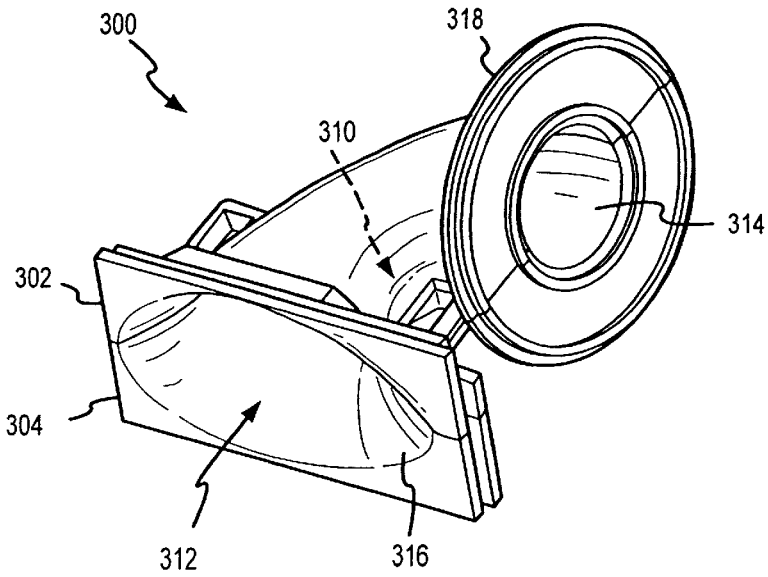
FIG. 6 is an isometric view of the intake duct of FIG. 5.
Figure 7:
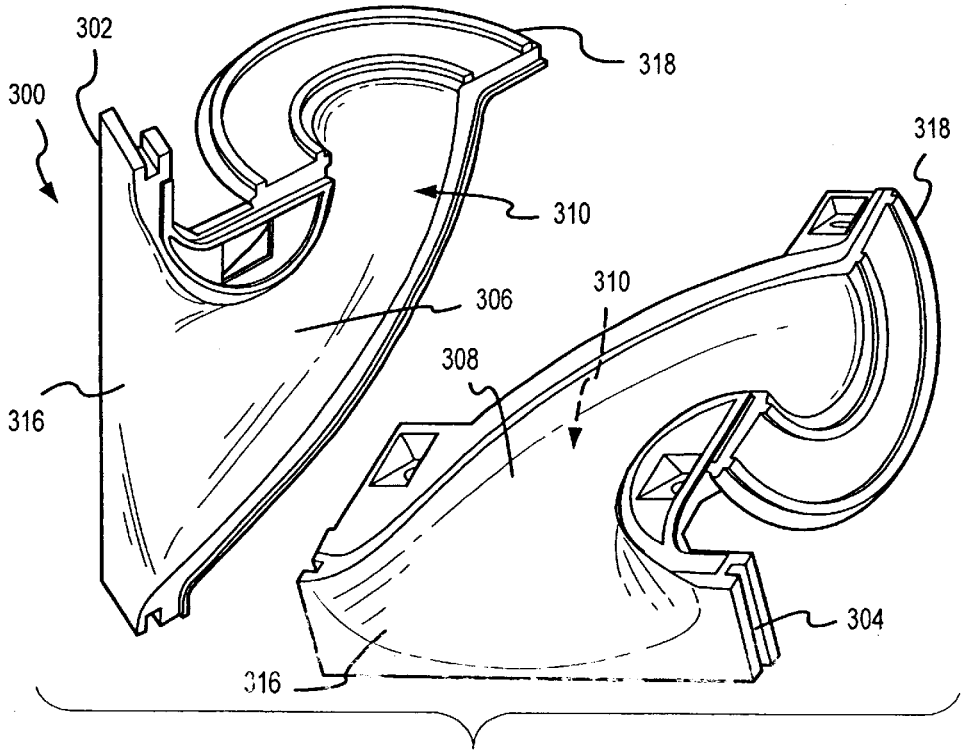
FIG. 7 is an exploded isometric view of the intake duct of FIG. 5.

FIGS. 6 and 7 are isometric and exploded isometric views, respectively, of the intake duct 300 of FIG. 5. In this embodiment, the intake duct 300 includes an upper part 302 and a lower part 304. As best shown in FIG. 7, the upper part 302 includes a first contoured surface 306 and the lower part includes a second contoured surface 308. The first and second contoured surfaces 306, 308 form a contoured intake passage 310 therebetween, the intake passage 310 having an approximately oval-shaped inlet 312 at one end, and an approximately circular outlet 314 at an opposite end. The intake passage 310 has a cross-sectional area progression from the inlet 312 to the outlet 314 that is smoothly varying and free from step-changes or other discontinuities. The first and second contoured surfaces 306, 308 also form a smoothly contoured bellmouth 316 defining the inlet 312. A flange 318 surrounds and projects radially outwardly around the circular outlet 314.

The intake duct 300 may be formed of any suitable material, but preferably is formed of a durable, lightweight thermoplastic material. The intake duct 300 may be formed of two mirror-image parts, as shown in FIGS. 6 and 7, or alternately, may be formed from a single part or a plurality of parts. The parts of the intake duct 300 may be formed using known manufacturing techniques, including, for example, casting, machining, or injection molding. The upper and lower parts 302, 304 may be connected using fasteners (e.g. screws, bolts, rivets, clips, etc.) or may be bonded using known methods, such as adhesives, thermo-bonding, or vibratory welding.

In the embodiment shown in FIGS. 6 and 7, the cross-sectional area of the oval-shaped inlet is larger than the cross-sectional area of the circular outlet.

The cross-sectional area progression of the intake passage 310 therefore involves both a convergence (i.e. decreasing cross-sectional area) from the inlet to the outlet, and also a change of shape from an approximately oval cross-sectional shape to a circular cross-sectional shape. In another embodiment, the cross-sectional area progression of the intake passage may be varied such that the cross-sectional area of the inlet is equal to the cross-sectional area of the outlet, in which case the cross-sectional area progression may involve only a smoothly varying change of shape. In a further embodiment, the cross-sectional area of the inlet may be different from the cross-sectional area of the outlet, and the cross-sectional area progression from the inlet to the outlet may converge (or diverge) at a constant rate.

Referring again to FIGS. 6 and 7, in other embodiments, the bellmouth 316 defining the inlet 312 may have a greater or lesser amount of curvature than shown in the accompanying figures. In the embodiment shown in FIGS. 6 and 7, the radius of the bellmouth 316 varies around the perimeter of the inlet 312 from approximately 4.0 inches near the sides of the approximately-oval shape to approximately 1.0 inches near the upper and lower edges of the approximately-oval shape, with an average radius of approximately 1.5 inches. In other embodiments, the radius of the bellmouth may be greater or less than the particular embodiment shown in the accompanying figures. In further embodiments, the radius of the bellmouth may be held constant about the entire periphery of the inlet, or alternately, the bellmouth 316 may be eliminated.

During operation of the floor care machine 100, a particulate-laden airstream is drawn into the suction compartment 160 by the airflow propulsion device 200. The particulate-laden airstream enters the inlet 312 of the intake duct 300, travels through the intake passage 310, and passes out of the intake passage 310 through the outlet 314. Preferably, the outlet 314 is sized to match the central opening 260 of the airflow propulsion device 200.

One advantage of the intake duct 300 is that turbulence of the particulate-laden airstream within the intake passage 310 may be reduced or inhibited from increasing. Because the surface of the intake passage 310 is smoothly varying and free from step-changes or other discontinuities, adverse pressure gradients caused by such discontinuities are reduced or eliminated, and the particulate-laden airstream is more likely to remain attached to the interior surface of the intake passage 310. Because the airstream is more likely to remain attached rather than become separated from the interior surface, the turbulence of the particulate-laden airstream within the intake passage 310 is less likely to be increased, and may be decreased, as the airstream traverses the intake passage 310, compared with the prior art intake components described above. A result of this reduction or inhibition of turbulence within the intake passage is that the noise generated by the airstream within the intake passage may be reduced.

Another advantage of the intake duct 300 is that the bellmouth 316 further reduces the likelihood that the airstream will become separated from the interior surface of the intake passage 310. Because the bellmouth 316 allows the airstream to enter the intake passage 310 with more gradual turning around the entire periphery of the inlet 312, the airstream is less likely to become separated from the interior surface of the intake passage 310 near the inlet 312. Because the airstream remains attached to the intake passage 310 near the inlet 312, the turbulence of the particulate-laden airstream within the intake passage 310 is less likely to be increased, and may be decreased, as the airstream traverses the intake passage 310, compared with the prior art intake components described above. Again this effect may reduce the noise generated by the airstream within the intake passage.

Yet another advantage of the intake duct 300 is that the intake passage 310 has a converging cross-sectional area progression from the inlet 312 to the outlet 314. As the flow traverses the converging intake passage 310, the airstream accelerates, producing favorable pressure gradients within the intake passage 310. This effect may further reduce the likelihood that the airstream will become separated from the interior surface of the intake passage 310, thereby reducing or inhibiting the increase of turbulence. Again, this may further reduce the noise generated by the airstream within the intake passage.

Figure 8:
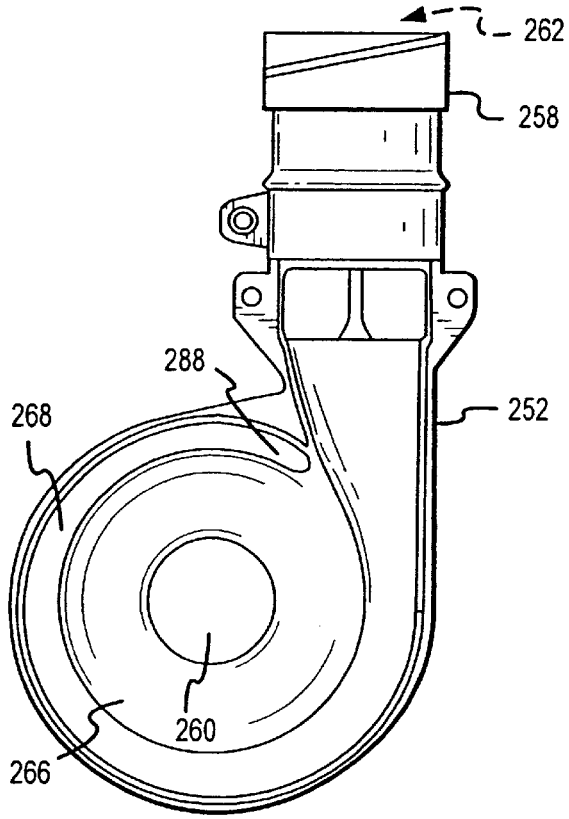
FIG. 8 is a side elevational view of a left portion of the fan housing of FIG. 5.
Figure 9:
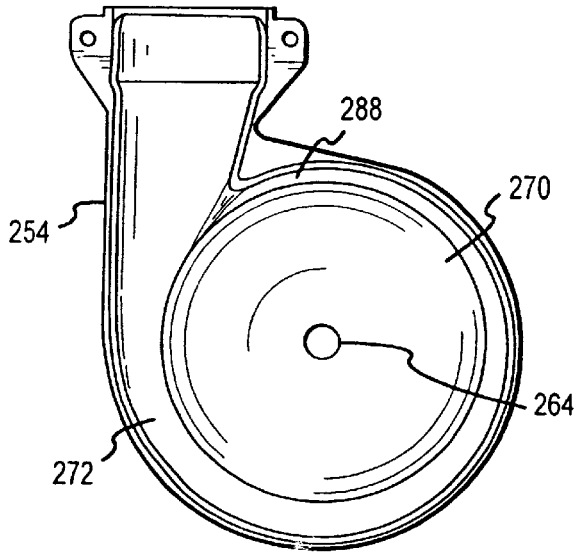
FIG. 9 is an isometric view of a right portion of the fan housing of FIG. 5.

FIGS. 8 and 9 are side elevational views of the left, and right portions 252, 254, respectively, of the fan housing 250 of FIG. 5. As shown in FIG. 8, the left portion 252 includes a partially-conical cowling surface 266 having the central opening 260 disposed therein, and a left transitional surface 268 disposed radially outwardly from the cowling surface 266. Similarly, the right portion 254 (FIG. 9) includes a substantially flat seating surface 270 and a right transitional surface 272 disposed radially outwardly therefrom.

Figure 10:
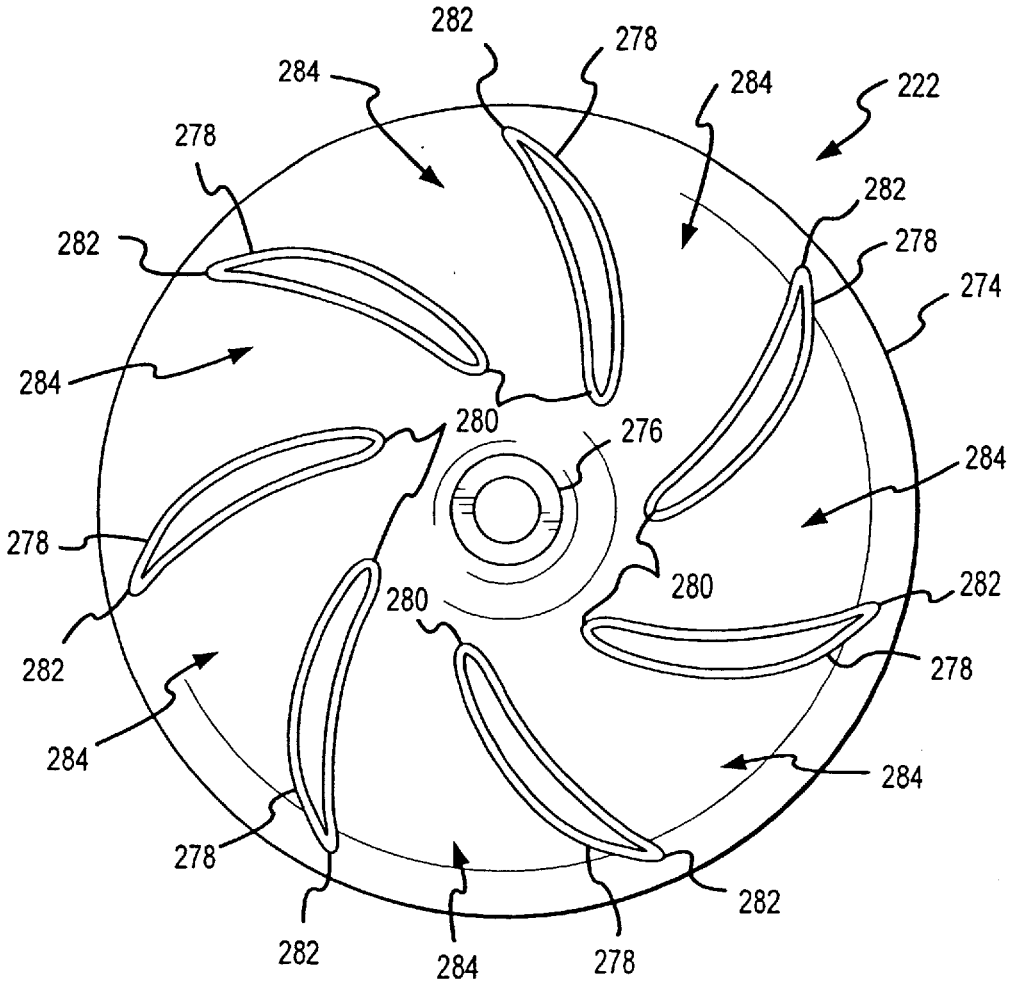
FIG. 10 is a top plan view of a fan of FIG. 5.
Figure 11:
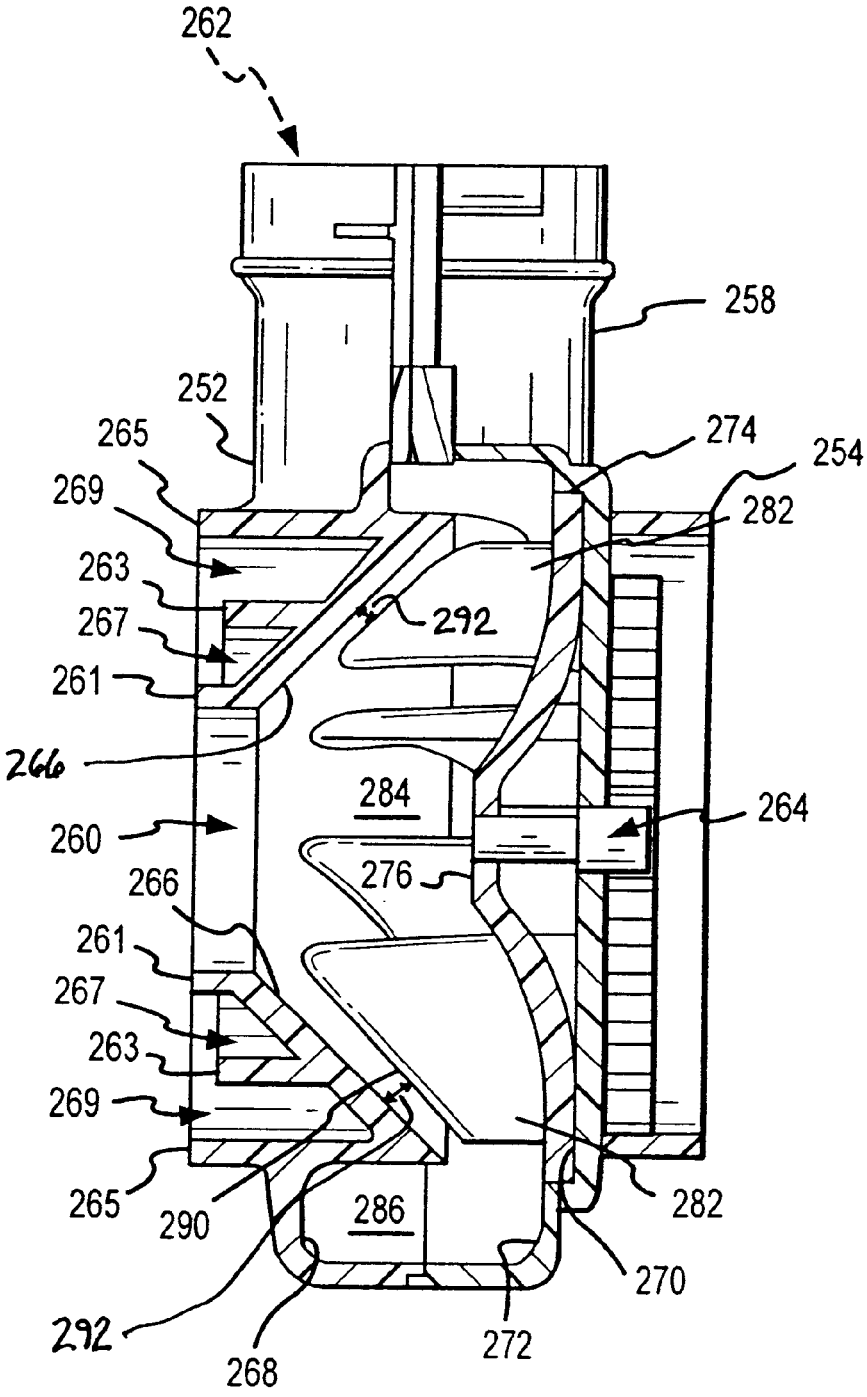
FIG. 11 is a cross sectional view of the assembled fan housing and fan of FIG. 5.

FIG. 10 is a top plan view of the fan 222 of FIG. 5. The fan 222 (FIG. 10) includes a fan disk 274 and a raised central hub 276. A plurality of spaced-apart vanes 278 are attached to the fan disk 274 and extend radially outwardly from the hub 276. Each vane 278 has an inner edge 280 near the central hub 276, and an outer edge 282 spaced radially outwardly from the inner edge 280. Each vane 278 also has a generally concave cross-sectional shape. Adjacent vanes 278 are spaced from each other to define a plurality of channels 284 therebetween. In the embodiment shown in FIG. 10, the cross-sectional area of each channel 284 remains approximately constant throughout the length of the channel 284. This is accomplished by decreasing the height H of each channel 284 as the width W the channel 284 increases in the radial direction from the inner edge 280 to the outer edge 282 of the vane 278. The channels 284 may be diverging channels. FIG. 11 is a cross-sectional view of the assembled fan housing 250 and fan 222 of FIG. 5. In the assembled position, the left and right transitional surfaces 268, 272 of the left and right portions 252, 254 are aligned to form a transition duct 286 therebetween. The fan disk 274 of the fan 222 is positioned proximate the seating surface 270 of the right portion 254, and the vanes 278 are positioned proximate the cowling surface 266 of the left portion 252. A distal edge 290 of each vane 278 is spaced apart from the cowling surface 266 by a narrow cowling space 292. Preferably, the cowling space 292 is maintained at a value of approximately 0.10 inches or less. As the fan 222 is rotated by the motor 202 (FIG. 4), the fan 222 draws the flow of air and particulates through the central opening 260, pressurizes or imparts momentum to the flow, and directs the flow outwardly through the plurality of channels 284 to the transition duct 286. The transition duct 286 captures the particulate-laden flow existing from the channels 284 and directs the flow into the coupling section 258 that leads to the exhaust duct 128. In one aspect of the fan housing 250, the transition duct 286 has a smoothly continuous, progressively increasing cross-sectional area along the direction of the particulate-laden airstream from a first end 288 (FIGS. 8 and 9) of the transition duct 286 to the coupling section 258.

One advantage of the fan housing 250 is that the transition duct 286 may reduce or inhibit the development of turbulence in the particulate-laden airstream. Because the transition duct 286 is smoothly varying and free from step-changes or other discontinuities, adverse pressure gradients caused by discontinuities are reduced or eliminated. The particulate-laden airstream is therefore more likely to remain attached to the interior surface of the transition duct 286. Because the airstream is more likely to remain attached rather than become separated from the interior surface, the turbulence of the particulate-laden airstream within the transition duct 286 is less likely to be increased, and may be decreased, as the airstream traverses the transition duct 286. A result of this reduction or inhibition of turbulence Within the transition duct 286 is that the noise generated by the particulate-laden airstream within the fan housing 250 may be reduced.

Another advantage of the fan housing 250 is that the cowling space 292 (FIG. 11) between the distal edges 290 of the vanes 278 and the conical cowling 266 is much smaller than in prior art fan housings. Because the cowling 266 is shaped to confirm to the shapes of the distal edges. 290 of the vanes 278, the cowling space 292 is narrow, and reduced considerably compared with prior art fan housings, including, for example, the type disclosed in U.S. Pat. No. 5,584,095. As best shown in FIG. 16 of U.S. Pat. No. 5,584,095, prior art fan housings do not include a cowling 266 that closely conforms to the distal edges of the vanes. Rather, prior art devices allow the fan to rotate in a relatively larger, more open chamber having an inner surface that is spaced relatively widely apart from, and does not closely conform to, the distal edges 290 of the vanes 278.

In an embodiment of the present invention, the fan housing 250 includes the cowling 266 that closely conforms to the distal edges 290 of the vanes 278. Thus, the performance of the fan housing 250 over prior art fan housings may be improved. The closely conforming cowling 266 and reduced cowling space 292 may result in reduced edge losses over the distal edges 290 of the vanes 278, thereby improving the efficiency of the fan 222. Furthermore, the turbulence and noise generated by the fan 222 within the fan housing 250 may also be reduced. In addition, the reduced size of the cowling space 292 may advantageously increase the pressure generated by the fan 222, reducing losses and improving the efficiency and overall performance of the fan housing assembly.

As best shown in FIG. 11, the left portion 252 also includes an inner rib 261 disposed about the central opening 260 (see also FIG. 5) and projecting outwardly from the fan housing 250 toward the intake duct 300. A central rib 263 is spaced radially outwardly from the inner rib 261, and finally, an outer rib 265 is spaced radially outwardly from the central rib 263. The inner and outer ribs 261, 265 are approximately equal in height. The central rib 263 is shorter than the inner and outer ribs 261, 265 by a distance that is approximately equal to, or slightly less than, the thickness of the seal 224 (FIGS. 4 and 5). An inner well 267 is formed between the inner and central ribs 261, 263, and an outer well 269 is formed between the central and outer ribs 263, 265.

During assembly, the seal 224 is engaged between the inner and outer ribs 261, 265 and against the central rib 263. The seal 224 substantially covers the inner and outer wells 267, 269. In the embodiment shown in FIG. 11, the depth of the inner well 267 is approximately 2 to 3 times the thickness of the seal 224, while the depth of the outer well 269 is approximately 5 to 6 times the thickness of the seal 224.

Figure 12:
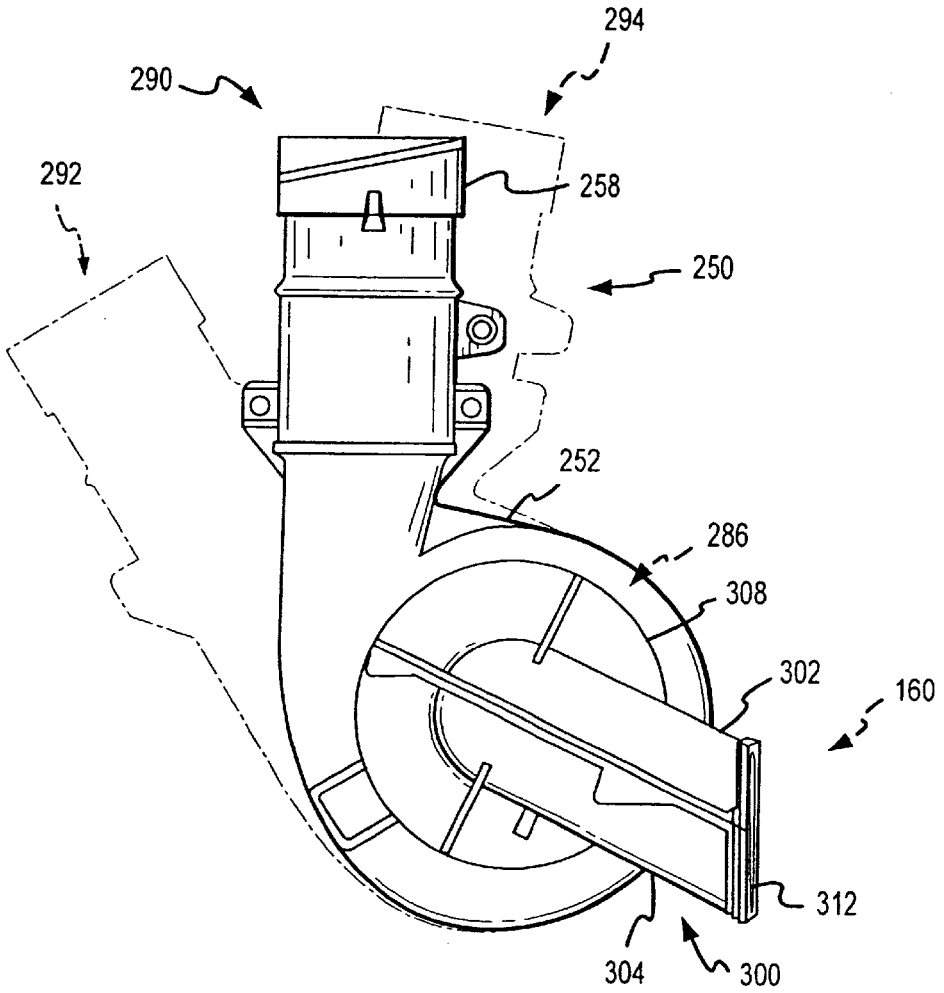
FIG. 12 is a side elevational assembly view of the assembled intake duct and fan housing of FIG. 5.

FIG. 12 is a side elevational view of the assembled intake duct 300 and fan housing 250 of FIG. 5. In the assembled position, the flange 308 of the intake duct 300 is engaged against the inner and outer ribs 261, 265 of the fan housing 250. The seal 224 (FIG. 5) is closely captured between the flange 308 and the inner and outer ribs 261, 265, and is pressed into sealing engagement with the central rib 263. Preferably, the seal 224 is formed of a resilient material with a low coefficient of friction, at least on the side of the seal 224 adjacent the flange 308.

The intake duct 300 is fixedly attached to the upper housing 158 (FIG. 4) with the bellmouth 312 in fluid communication with the suction compartment 160. The fan housing 250 is rotatably supported between curved supports 157 on the lower and upper housings 156, 154 (FIG. 4) so that the fan housing 250 may rotate with respect to the intake duct 300 between a parked position 294 (typically 10 to 20 degrees forward from vertical), an upright position 290 (vertical), and an inclined position 292. As the operator of the floor care machine 100 lowers the handle 132, such as for vacuuming under a table or other furniture, the fan housing 250 pivots into the inclined position 292. In one embodiment, the inclined position 292 may be 90 degrees from the upright position 290 (over 90 degrees from the parked position 294), such as when the operator lowers the handle 132 all the way to the floor surface 22. As the fan housing 250 pivots, the seal 224 may slide with respect to the flange 308 of the intake duct 300. Alternately, the seal 224 may slide with respect to the ribs 261, 263, 265.

The fan housing 250 having the inner, central, and outer ribs 261, 263, 265 may advantageously firm,prove the serviceability of the airflow propulsion device 200. Because leakage may occur around the seal 224, any particulates that may pass through the interface between the seal 224 and the outer rib 265 may be trapped within the outer well 269. Similarly, any particulates that may pass through the interface between the seal 224 and the central rib 263 may be trapped within the inner well 267. Because the inner and outer wells 267, 269 are large (approximately 2 to 3 times the thickness of the seal 224 and approximately 5 to 6 times the thickness of the seal 224, respectively), the capacity of the wells to collect and store particulates that may leak around the seal 224 is increased. Thus, the requirement for disassembly of the intake duct 300 from the fan housing 250 for cleaning the wells 267, 269 may be reduced, and the efficiency of the floor care machine 100 may be improved.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other contoured intake ducts and fan housing assemblies for floor care machines, and not just to the embodiments described above and shown in the accompanying figures. Accordingly, the scope of the invention should be determined from the following claims:

What is claimed is:

1. An airflow propulsion device for a floor care machine, comprising:

a motor having a drive shaft;

a fan operatively coupled to the drive shaft and having a plurality of radially-extending vanes, each vane having a radially-inward end and a radially-outward end, the fan being rotatable such that an airflow may be driven radially-outwardly along the vanes from the radially-inward ends to the radially-outward ends;

a fan housing disposed about the fan and having an inlet opening proximate the radially-inward ends of the vanes and a transition passage proximate the radially-outward ends of the vanes, the transition passage extending to an exhaust opening and being sized to receive the outwardly-driven airflow from the fan, the transition passage further having a first cross-sectional area proximate a first one of the vanes and a second cross-sectional area proximate the exhaust opening, and a cross-sectional area progression that smoothly varies between the first cross-sectional area and the second cross-sectional area;

an inlet axis projecting from the inlet opening; and wherein the fan housing further comprises:

a first rib protecting outwardly co-axially with the inlet axis and substantially surrounding the inlet opening;

a second rib projecting outwardly co-axially with the inlet axis and substantially surrounding the first rib, an inner well being formed between the first and second ribs; and a third rib protecting outwardly co-axially with the inlet axis and substantially surrounding the second rib, an outer well being formed between the first and second ribs.

2. The airflow propulsion device of claim 1 wherein the cross-sectional area progression of the transition passage comprises a constant cross-sectional area progression.

3. The airflow propulsion device of claim 1 wherein the first cross-sectional area is less than the second cross-sectional area.

4. The airflow propulsion device of claim 1 wherein the fan housing comprises a first portion and a second portion, the first and second portions being thermally bonded by a vibratory welding process.

5. An airflow propulsion device for a floor care machine, comprising:

a motor having a drive shaft;

a fan having a fan disk operatively coupled to the drive shaft and having a plurality of radially-extending vanes projecting outwardly from the fan disk, each vane having a radially-inward end and a radially-outward end, the fan being rotatable such that an airflow may be driven radially-outwardly along the vanes from the radially-inward ends to the radially-outward ends, each vane further having a base edge attached to the fan disk and a slanted distal edge opposite the base edge; and a fan housing disposed about the fan and having an inlet opening proximate the radially-inward ends of the vanes and a transition passage proximate the radially-outward ends of the vanes, the transition passage extending to an exhaust opening and being sized to receive the outwardly-driven airflow from the fan, the fan housing including an internal cowling surface closely spaced from the distal edges and comprising a partially conical surface.

6. The airflow propulsion device of claim 5 wherein the cowling surface is spaced apart from the distal edges by a closely conforming cowling space.

7. The airflow propulsion device of claim 6 wherein the closely conforming cowling space is no greater than approximately 0.10 inches.

8. The airflow propulsion device of claim 5 wherein the fan housing comprises a first portion and a second portion, the first and second portions being thermally bonded by a vibratory welding process.

9. The airflow propulsion device of claim 5 wherein the inlet opening has an inlet axis projecting therefrom, the fan housing further comprising:

a first rib projecting outwardly co axially with the inlet axis and substantially surrounding the inlet opening;

a second rib projecting outwardly coaxially with the inlet axis and substantially surrounding the first rib, an inner well being formed between the first and second ribs; and a third rib projecting outwardly co-axially with the inlet axis and substantially surrounding the second rib, an outer well being formed between the first and second ribs.

* * * * *